US009739110B2

(12) United States Patent
Molaschi

(10) Patent No.: US 9,739,110 B2
(45) Date of Patent: Aug. 22, 2017

(54) EMERGENCY VALVE ASSEMBLY FOR EXTRACTION WELLS, WELL EQUIPPED WITH SAID VALVE AND PROCESS FOR MANAGING AN EXTRACTION WELL WITH SAID VALVE UNDER EMERGENCY CONDITIONS

(71) Applicant: ENI S.P.A., Rome (IT)

(72) Inventor: Claudio Molaschi, Crema (IT)

(73) Assignee: ENI S.p.A., Rome (IT)

( * ) Notice: Subject to any disclaimer, the term of this patent is extended or adjusted under 35 U.S.C. 154(b) by 3 days.

(21) Appl. No.: 14/892,769

(22) PCT Filed: May 23, 2014

(86) PCT No.: PCT/IB2014/061660

§ 371 (c)(1),
(2) Date: Nov. 20, 2015

(87) PCT Pub. No.: WO2014/188387

PCT Pub. Date: Nov. 27, 2014

(65) Prior Publication Data

US 2016/0102519 A1 Apr. 14, 2016

(30) Foreign Application Priority Data

May 24, 2013 (IT) ..... MI2013A0845

(51) Int. Cl.
*E21B 33/064* (2006.01)
*E21B 34/04* (2006.01)
(Continued)

(52) U.S. Cl.
CPC ..... *E21B 33/064* (2013.01); *E21B 21/001* (2013.01); *E21B 29/02* (2013.01); *E21B 29/08* (2013.01); *E21B 34/04* (2013.01)

(58) Field of Classification Search
CPC ..... E21B 21/001; E21B 29/02; E21B 29/08; E21B 33/064; E21B 34/04
See application file for complete search history.

(56) References Cited

U.S. PATENT DOCUMENTS 3,729,170 A 4/1973 Lewis et al.
4,572,298 A 2/1986 Weston
(Continued)

FOREIGN PATENT DOCUMENTS

CN 201265382 Y 7/2009
CN 202249880 U 5/2012
(Continued)

OTHER PUBLICATIONS

Combined Chinese Office Action and Search Report issued on Dec. 1, 2016 in Patent Application No. 201480029564.6 (with English translation).

(Continued)

*Primary Examiner* — James G Sayre
(74) *Attorney, Agent, or Firm* — Oblon, McClelland, Maier & Neustadt, L.L.P.

(57) ABSTRACT

The emergency valve assembly (5) for extraction wells according to the invention comprises A) an external housing (50) and B) a rotating stopper (54). The pass-through duct (52) is arranged for the passage of a production and/or drilling line arranged for containing and carrying, through at least one relative pipe (9), extraction fluids such as, for example, petroleum, oil, water, sludge, rock debris and/or earth, natural gas, or other fluids extracted from an underground reservoir. The valve (5) also comprises a stopper drive (56), arranged for actuating the rotating stopper (54) making it rotate so as to shear the production or perforation line passing through it, in particular shearing the pipe (9) and closing the pass-through duct (52). The pass-through duct (52, 520) has a minimum passage section having a diameter (Continued)

equal to or greater than seven inches. It provides an effective additional safety measure in the case of emergencies.

17 Claims, 5 Drawing Sheets

(51) Int. Cl.
*E21B 29/08* (2006.01)
*E21B 29/02* (2006.01)
*E21B 21/00* (2006.01)

(56) References Cited

U.S. PATENT DOCUMENTS 4,681,133 A * 7/1987 Weston ..... E21B 29/04 137/315.18
4,703,807 A 11/1987 Weston
4,840,346 A * 6/1989 Adnyana ..... E21B 33/062 166/363
5,167,283 A * 12/1992 Smith ..... E21B 21/001 166/373
5,316,087 A * 5/1994 Manke ..... E21B 23/065 166/381
2012/0325491 A1 * 12/2012 Allensworth ..... E21B 34/063 166/363

FOREIGN PATENT DOCUMENTS

GB 2 304 860 A 3/1997
GB WO 2015071694 A3 * 9/2015 ..... E21B 33/061
WO WO 84/01799 5/1984

OTHER PUBLICATIONS

International Search Report and Written Opinion issued Dec. 4, 2014 in PCT/IB2014/061660.

* cited by examiner

EMERGENCY VALVE ASSEMBLY FOR EXTRACTION WELLS, WELL EQUIPPED WITH SAID VALVE AND PROCESS FOR MANAGING AN EXTRACTION WELL WITH SAID VALVE UNDER EMERGENCY CONDITIONS

CROSS-REFERENCE TO RELATED APPLICATIONS

This application is a National Stage of PCT/IB2014/061660, which was filed on May 23, 2015. This application is based upon and claims the benefit of priority to Italian Application No. MI2013A 000845, which was filed on May 24, 2013.

FIELD OF THE INVENTION

The present invention relates to an emergency valve assembly for managing extraction wells—such as, for example, wells for the extraction of petroleum and/or natural gas—under emergency conditions, for example in the case of blow-outs. The invention also relates to a well equipped with said valve and a process for managing an extraction well with said valve under emergency conditions.

STATE OF THE ART

The environmental disaster of the Deepwater Horizon platform, which took place in 2010 in the Gulf of Mexico, reiterated the necessity of improving systems for blocking the blow-out of hydrocarbons or natural gas from reservoirs under emergency conditions. In particular, the Deepwater Horizon disaster revealed how safety systems against blow-outs of hydrocarbons from reservoirs, with which current wells, either in the drilling phase or already in production, are equipped, can at times prove to be inadequate.

Apart from this incident, also the positioning of well-heads on sea or ocean floors at depths which have now reached 3,000 meters, and the difficulty of intervening to block gas or oil leakages at these depths, are such that the necessity is even more strongly felt for additional safety systems with respect to the current blow-out preventers (BOP) installed on Christmas trees, or safety valves at present inside the well head.

An objective of the present invention is to overcome the drawbacks of the state of the art mentioned above, and in particular provide a safety system for preventing or blocking blow-outs of hydrocarbons or natural gas from extraction wells, capable of intervening when the current safety systems have proved to be ineffective or are unable to operate.

SUMMARY OF THE INVENTION

This objective is achieved, in a first aspect of the present invention, with an emergency valve assembly having the characteristics according to claim 1.

In a second aspect of the invention, this objective is achieved with an extraction well having the characteristics according to claim 10.

In a third aspect of the invention, this objective is achieved with a process for managing an extraction well under emergency conditions, having the characteristics according to claim 12.

Further characteristics of the device are object of the dependent claims.

The advantages obtained with the present invention will appear more evident, to a technical expert in the field, from the following detailed description of a particular non-limiting embodiment, illustrated with reference to the following schematic figures.

LIST OF FIGURES

DETAILED DESCRIPTION

In the present description, the expressions "upstream" and "downstream" indicate positions respectively closer to and further away from the reservoir to be exploited; analogously, the expressions "from upstream" and "from downstream" indicate movements with directions in accordance with and contrary to the flow of the fluid which is extracted from the reservoir.

FIGS. 1-5 relate to a well head assembly, indicated with the overall reference number 1, according to a particular embodiment of the invention conceived for exploiting an already complete well.

The assembly 1 can comprise the actual well head 3, the assembly of the emergency valve 5 and the completion tree—also called Christmas tree—7.

Figure 1:
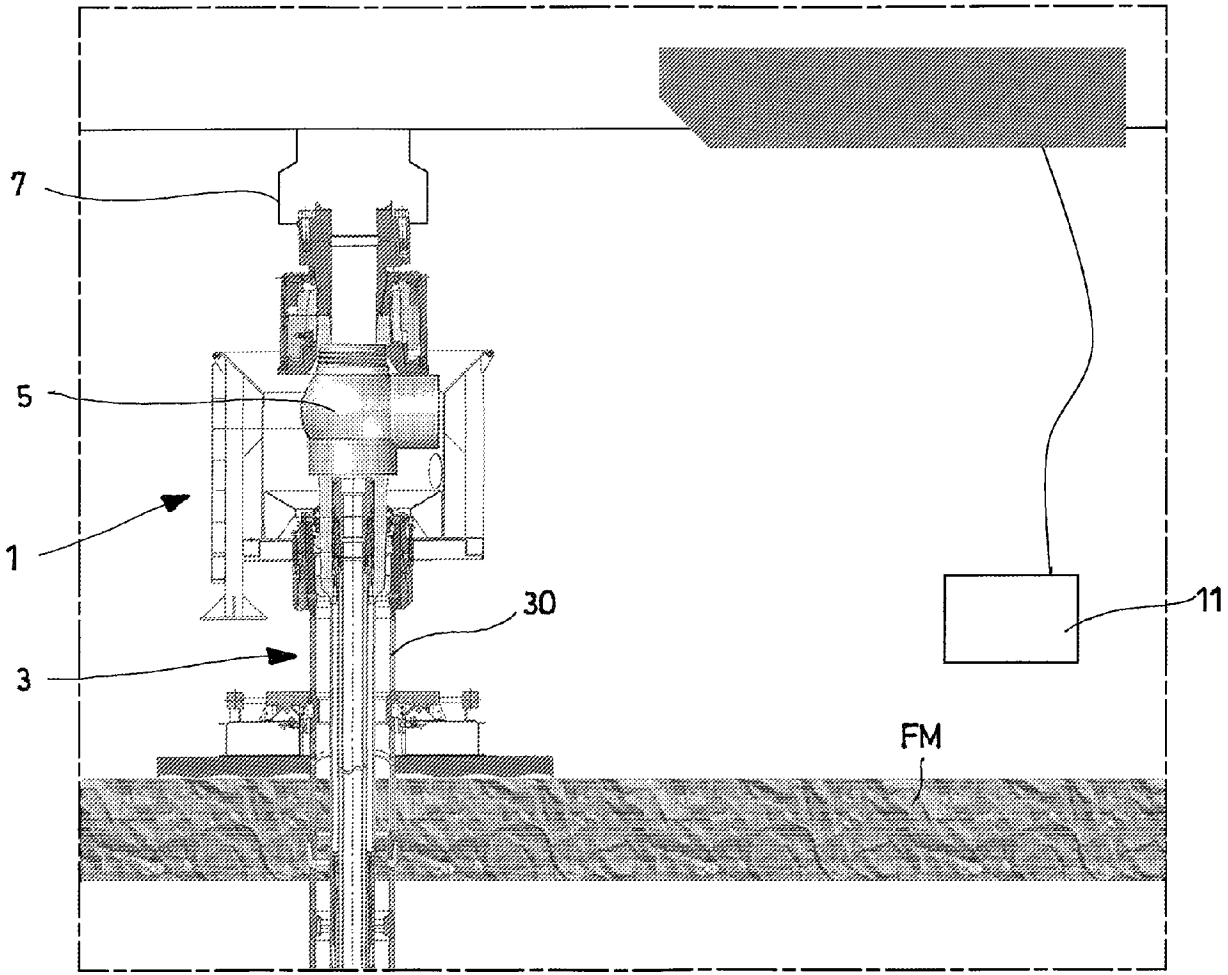
FIG. 1 shows an elevation, partially sectional view of an extraction well equipped with a well head assembly according to a particular embodiment of the invention.
Figure 2:
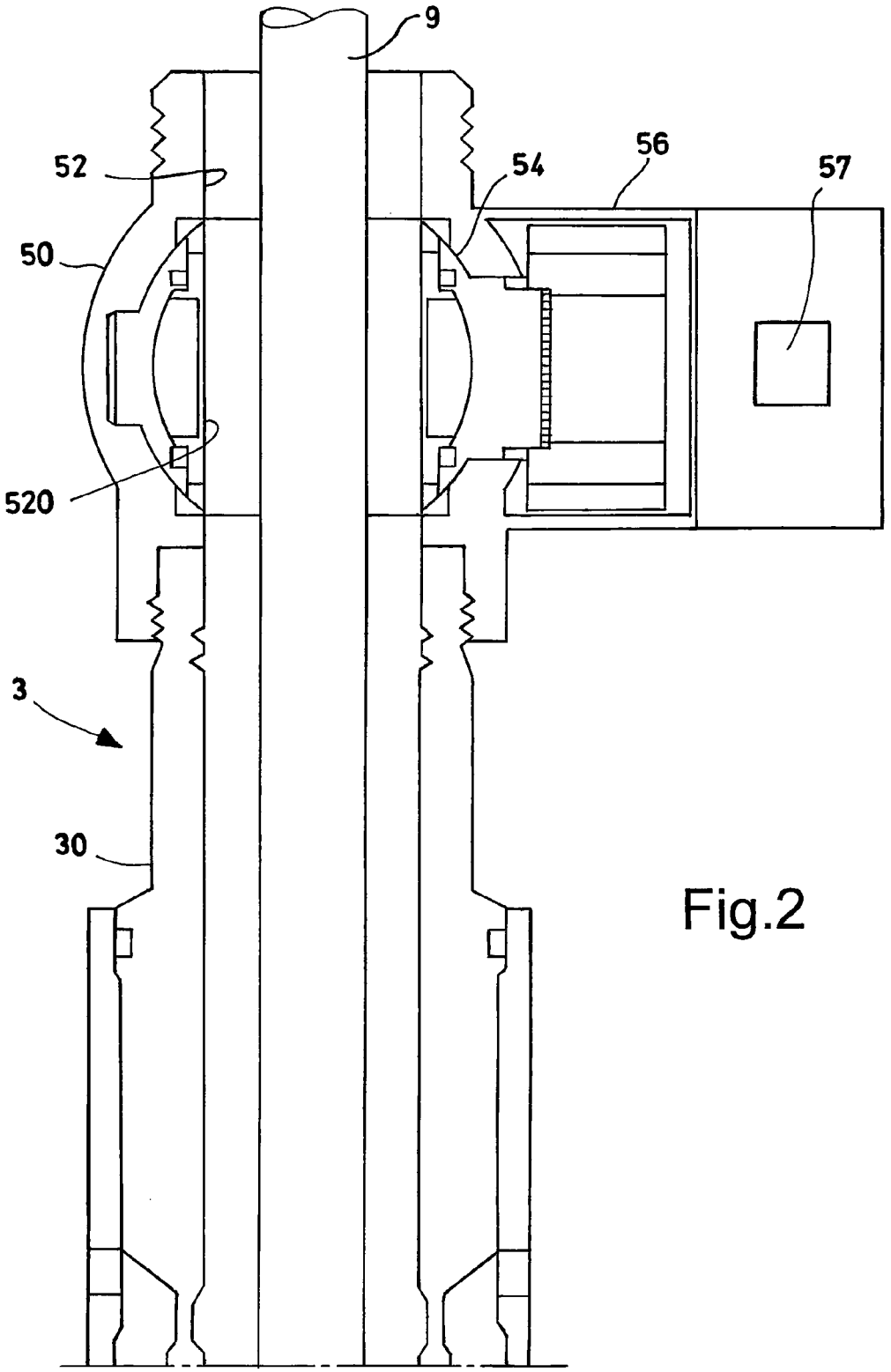
FIG. 2 shows a first partially sectional side view of the well head of FIG. 1, with the relative emergency valve.

The well head 3 can be of the known type and comprise for example a low-pressure housing and a high-pressure housing anchored to the seabed with a conductor pipe, which is generally a pipe having a thickness of 36"×1.5" cemented with another 20" pipe having the function of an anchoring column. More generically, the well head 3 can comprise an anchoring pipe 30 cemented, or in any case anchored or fixed to the seabed or other geological formation in which an underground reservoir to be exploited, lies, where the pipe 30 is close to the surface of the seabed or other geological formation in question; as shown in FIGS. 1, 2 an end of the anchoring pipe 30 can emerge or protrude from the bottom (FIGS. 1, 2).

The Christmas tree 7 can also be of the known type.

Figure 4:
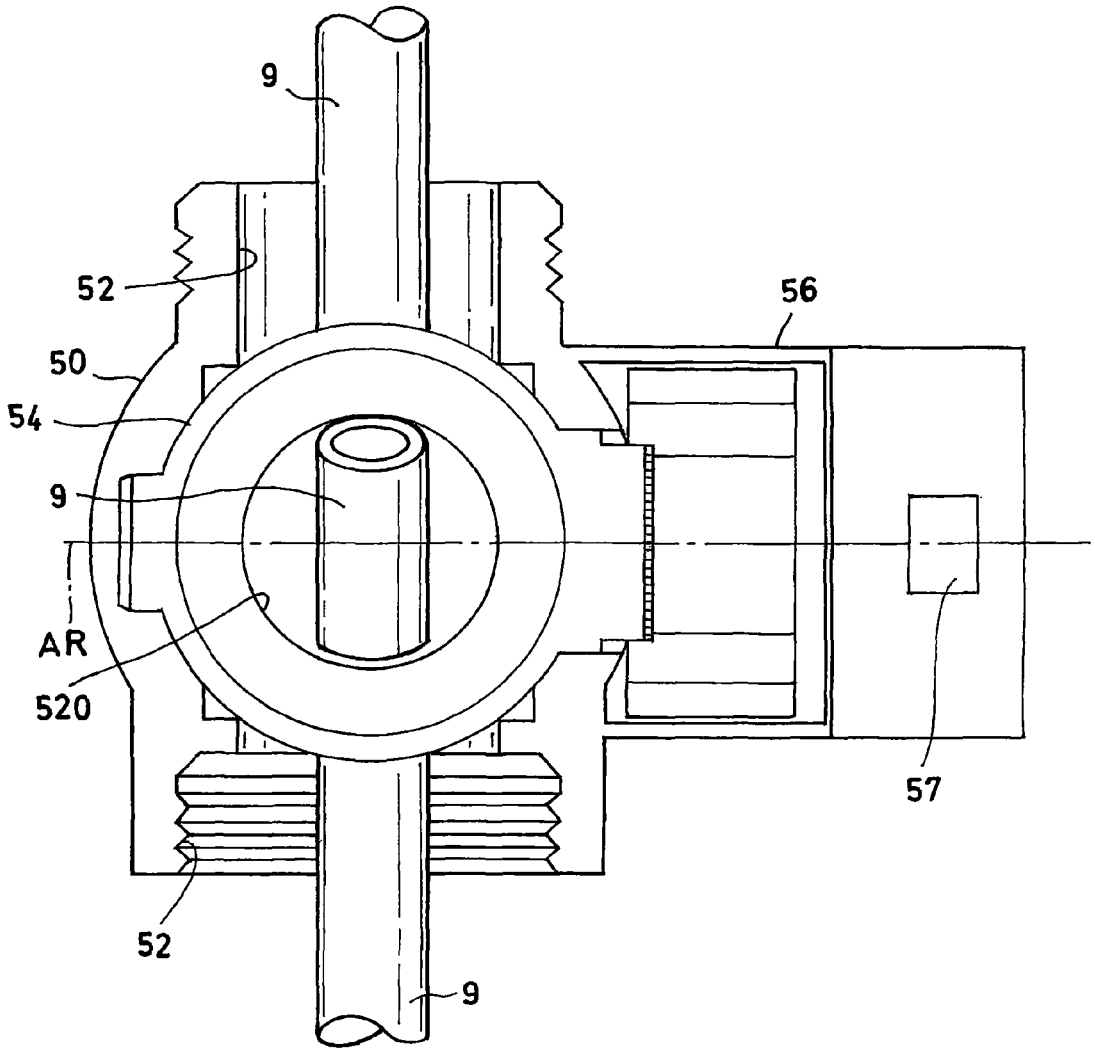
FIG. 4 shows a third partially sectional side view of the emergency valve of FIG. 2, after shearing the pipe of the extraction well.
Figure 5:
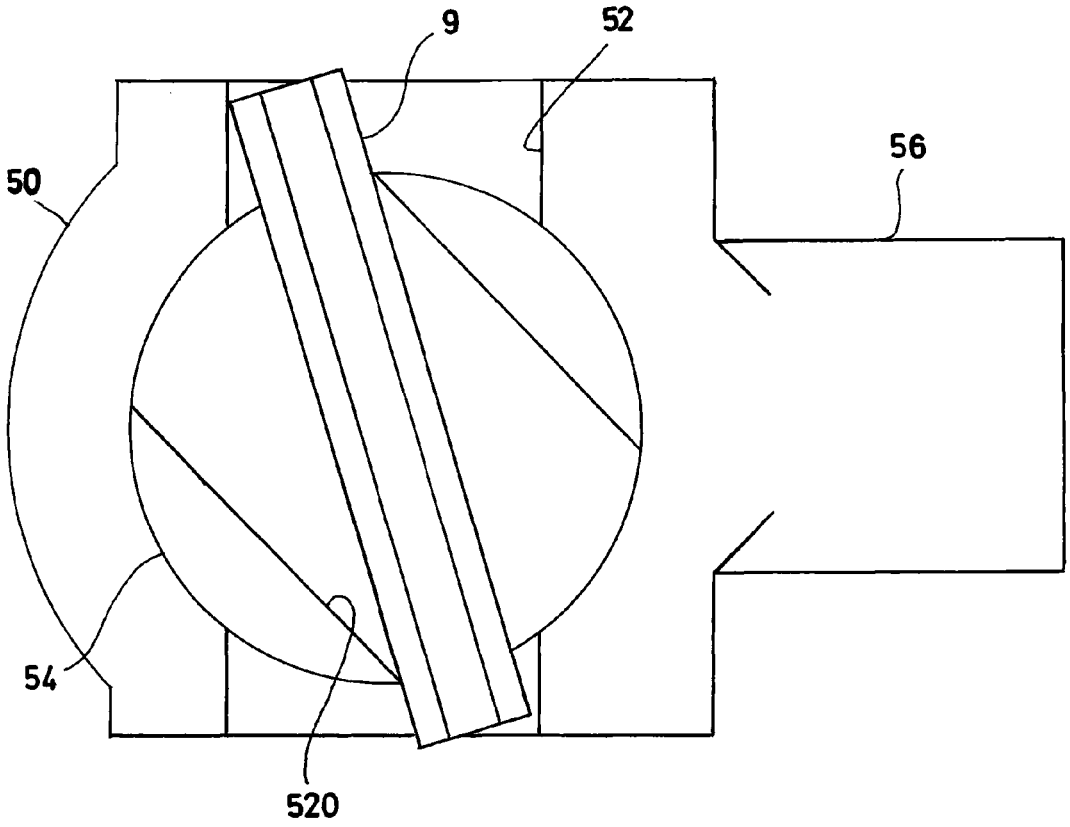
FIG. 5 shows a front view, according to the direction of the axis AR, of the emergency valve of FIG. 2 in the condition of FIG. 4.

According to an aspect of the invention, the emergency valve assembly 5 comprises:

an external housing 50 inside which a pass-through duct 52, preferably straight, is arranged;

a rotating stopper 54 which forms, in its interior, a section 520 of the pass-through duct, wherein the pass-through duct 52, including its section 520 arranged in the rotating stopper, is arranged for the passage of a production and/or drilling line arranged for containing and carrying, through one pipe 9, extraction fluids such as, for example petroleum, oil, water, sludge, rock debris and/or earth, natural gas, or other fluids to be extracted from an underground reservoir;

a stopper drive 56 arranged for actuating the rotating stopper 54 making it rotate so as to shear the production or drilling line passing through it, in particular shearing the pipe 9 and closing the pass-through duct 52, preferably sealed or in any case so as to block or at least withhold the outflow of the fluid to be extracted from the pass-through pipe 52 as much as possible (FIG. 4).

The pipes 9 can be so-called production tubing or pipe strings in technical jargon.

The rotating stopper 54 is preferably of the rotating ball type. The pass-through duct 52, when open, preferably has a substantially straight axis.

The rotating stopper 54 is arranged for shearing the pipe 9, or drilling or production line, rotating on itself around an axis AR transversal, and more preferably perpendicular, to the same pipe 9.

Again according to an aspect of the invention, the pass-through duct 52, 520 has a minimum passage section having a diameter equal to or greater than seven inches, so as to allow the passage of a drilling or production line having an adequate diameter and preferably less than seven inches, so as to leave adequate radial clearances between the internal walls of the pass-through duct 52, 520 and the drilling or production line, facilitating the shearing of the latter.

The internal diameter of the pass-through duct 52, 520 preferably corresponds to the maximum internal diameter envisaged on the basis of the nominal diameter of the BOPs or well head, high pressure housing, generally ranging from 13.625-18.625 inches. The internal diameter of the pass-through duct 52, 520 is more preferably equal to or greater than 13.625 inches, and more preferably equal to or greater than 18.625 inches. The internal diameter of the pass-through duct 52, 520 can, for example, be equal to 13-14 inches.

The emergency valve 5 is preferably arranged for receiving in the pass-through duct 52 and shearing both the intermediate sections of the drilling rods and also the tool joints connecting them. The drilling rods can have external diameters which reach 5-6.625 inches, thicknesses up to 0.29-0.36 inches and steel grades often equal to or greater than 80 Kpsi, for example within the range of 95-135 Kpsi; the corresponding tool joints can have maximum external diameters or transverse dimensions of up to 6.625-8.25 inches.

Figure 3:
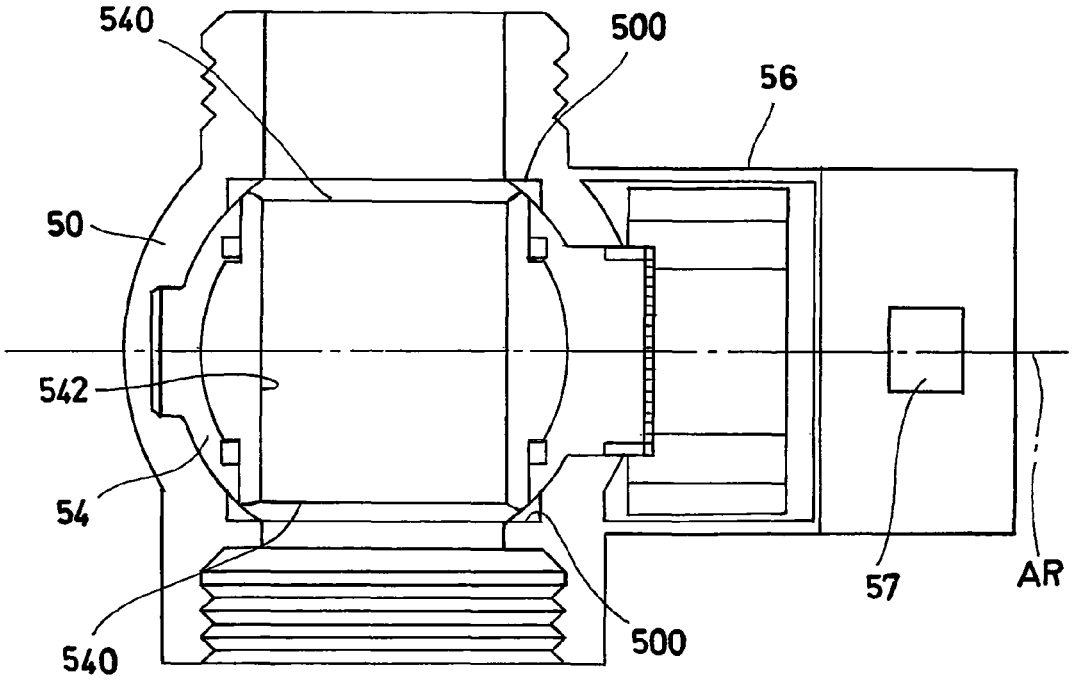
FIG. 3 shows a second partially sectional side view of the emergency valve of FIG. 2, before shearing the pipe of the extraction well.

The external housing 50 preferably forms a stopper seat in which the rotating stopper 54 can rotate so as to shear the pipe 9 of the production or drilling line—or more generally the tubular material inside the same line—which passes through the rotating stopper 54 itself, and close the extraction fluid duct, and the assembly valve 5 is arranged for shearing the production and/or drilling line, and in particular its pipe 9, by crushing it between at least a first edge 540 of the section of pass-through duct arranged on the rotating stopper, also referred to as "first cutting edge", and at least a second edge 500 arranged on the stopper seat, also referred to as "second cutting edge" (FIG. 3). As shown in FIG. 3, the emergency valve 5 can be equipped with two first cutting edges 540 and two second cutting edges 500, arranged for shearing the pipe 9 in correspondence with two different sections indicatively situated in correspondence with or close to the two mouths of the duct 542 which passes through the rotating stopper 54.

The stopper drive 56 advantageously comprises an expansion chamber 57 and is arranged for driving the rotating stopper 54, making it rotate so as to shear the pipe 9 of the production line which passes through the rotating stopper, and so as to close to the extraction fluid duct, expanding an explosive charge in the expansion chamber 57—in this case, the expansion chamber 57 is an explosion chamber—preferably not more than five times, more preferably not more than three times and even more preferably only once. The stopper drive 56 is arranged for actuating the rotating stopper 54, exploding, in the explosion chamber 57, an explosive preferably selected from the following group: a solid explosive product, a pyrotechnical charge. The stopper drive can be possibly equipped with a hydraulic drive (not shown) arranged for driving the rotating stopper 54 and in turn actuated by explosion gases generated in the chamber 57.

Alternatively, the explosion chamber 57 can be substituted by an expansion chamber (not shown) in which a suitable chemical substance is expanded, more slowly with respect to an explosion or a detonation, by gasifying, for example, a liquid or solid substance, which provides the driving energy for actuating the rotating stopper 54.

The stopper drive 56 is advantageously neither fed nor driven by possible hydraulic or electrical power systems which feed possible blow-up preventers downstream of the emergency valve 5. The transmission lines of signals from and towards the valve 5 are advantageously independent of those for the transmission of signals from and towards the adjacent blow-up preventers, so that the valve 5 represents a further and independent safety measure in the case of failure of the BOPs.

An example of the use and functioning of the emergency valve assembly previously described, is described hereunder.

The emergency valve assembly 5 can be assembled on a known well head 3, and more specifically for example, between the well head 3, the well head high pressure housing and the stack of BOPs. If the well is still in the drilling phase, one or more blow-out preventers of the known type can be assembled above the emergency valve 5; if, on the other hand, the well is already completed and in production, a Christmas tree, per se known, can be assembled above the emergency valve 5. As it is positioned between the well head and Christmas tree, the emergency valve 5 can also be used as a safety valve during work-overs, or at the annulus during production.

The pipes 9 of a production or drilling line are passed through the pass-through hole 542 of the rotating stopper 54. When the flow of oil, natural gas or other fluids leaving the well must be interrupted in an emergency situation, and the other blow-out preventers or other safety valves onboard the Christmas tree, if present, have not been able to intervene or have proved to be inefficient, the emergency valve 5 can be actuated, by activating in particular the stopper drive 56, by means of an acoustic command, for example, or the mechanical arm of a ROV 11 (Remotely Operated Vehicle, FIG. 1), exploding the explosive charge present onboard the emergency valve 5. The explosion gases produced by the explosive charge are collected in the explosion chamber 57 by considerably increasing the pressure in its interior, providing the mechanical energy necessary for rotating the rotating stopper 54. By rotating on itself, the stopper 54 first shears the section of pipe 9 which passes through the stopper 54 itself and subsequently, when neither of the two mouths of the duct 542 which passes through the rotating stopper 54 is in fluid communication with the sections of the pipe 9 above and below, or in any case upstream and downstream, of the valve 5, it closes these sections of the pipe 9 supporting them at the same time, and preventing not only the additional outflow of fluids from the reservoir but also the backflow of the fluids already extracted which are downstream of the valve 5, towards them. For this purpose, advantageously, the emergency valve 5 is provided with sealing gaskets.

For this purpose, the stopper 54 can rotate for example by about 90° (FIG. 4). The emergency valve 5 therefore irreversibly interrupts the pipe 9 used for the drilling or exploitation of the reservoir, but operates as a further and final blow-out preventer, or as a further and extreme safety valve in addition to those incorporated in the known Christmas trees. The rotating stopper 54 contributes in a particular way to limiting the overall encumbrances of the valve 5 with respect to other types of stopper, and also contributes in that it operates by shearing and not with other cutting systems.

The fact that the rotating stopper 54 acts by shearing, and that the stopper drive 56 is capable of assisting the stopper 54 in completing its shearing run, exploiting the expansion of the explosion gases of a limited number of explosions—from one to five, and preferably from one to three—allows the stopper 54 to be actuated also at considerable underwater depths, for example at depths of 1,000-4,500 meters, at which it is not possible or in any case extremely difficult to resort for example to complicated hydraulic, electric actuations or alternative combustion engines for providing the high torques necessary for shearing the pipe 9; the shearing preferably takes place without chip removal. The valve 5 is arranged for remaining blocked in closure after shearing the production or drilling line, and is possibly equipped with suitable mechanical, hydraulic or electric blocking systems. These blocking systems preferably allow the valve 5 to be subsequently to be unblocked and reopened, by means of ROVs, once the upper barrier formed by conventional BOPs has been restored.

The authors of the present invention have estimated that the shear force for each section, i.e. in correspondence with each of the two torques of first cutting edge 540/second cutting edge 500, must be in the order of 1,000 tons, corresponding to a drive torque of about 106 Nm, assuming an arm of one meter. At present, there are no reducers capable of supporting drive torques in the order of 106 Nm.

The stopper drive 56, on the contrary, is capable of housing onboard, in extremely reduced spaces, the pyrotechnical charges or in any case the necessary explosives, which in turn allow extremely simple drive mechanisms to be effected, which are therefore reliable and suitable for being situated on seabeds FM which are deep and isolated for extremely long periods of time, ideally for the whole operating life of the well. The above pyrotechnical charges or in any case explosives can also be preserved at considerable depths for extremely lengthy periods, possibly replacing them after pre-established periods within programmed maintenance interventions, or after use for recharging the system.

As the emergency valve 5 can be installed outside the well head 3, however, it can be produced with fewer design constraints with respect for example to current safety valves situated inside the well head.

The embodiment examples previously described can undergo numerous modifications and variations, all included in the protection scope of the present invention. The rotating stopper 54, for example, can be not only a ball stopper, but also a disc stopper or rotating drum stopper. The emergency valve 5 can be better integrated in the well head or in the blow-out preventers downstream thereof or assembled thereon, by ensuring, for example, that the external housing 50 is formed integrally in a single piece by the/an external housing of the well head or by the/an outer housing of the blow-out preventers; in the former case, the outer housing 50 can be formed integrally, for example, in a single piece by the external housing of the tubing head or of a casing head of the well head. The emergency valve 5 can be provided with a lever transmission system arranged for transmitting the mechanical power developed in the expansion or explosion chamber 57 to the rotating stopper 54, actuating the latter. The levers of this transmission system are advantageously at least partially outside the external housing 50 of the emergency valve, so as to impose fewer dimensional and project constraints and therefore facilitate a simple and reliable embodiment of the same valve. Furthermore, all the details can be substituted by technically equivalent elements. The materials used, for example, as also the dimensions, can vary according to technical requirements. It should be specified that an expression such as "A comprises B, C, D" or "A is composed of B, C, D" also comprises and describes the particular case in which "A consists of B, C, D". The examples and lists of possible variants of the present patent application should be considered as being non-exhaustive lists.

The invention claimed is:

1. An emergency valve assembly, comprising:

an external housing inside which a pass-through duct is arranged;

a rotating stopper, an interior of the rotating stopper comprising a section of the pass-through duct that is arranged for passage of at least one of a production line and a drilling line arranged to contain and carry extraction fluids through a pipe; and a stopper drive arranged to actuate a rotation of the rotating stopper so as to shear the production line or a perforation line passing through the rotating stopper thereby shearing the pipe and closing the pass-through duct;

wherein:

the pass-through duct comprises a minimum passage section having a diameter equal to or greater than seven inches; and the external housing further comprises a stopper seat in which the rotating stopper can rotate and the valve assembly is arranged to shear the production line or the drilling line by crushing the pipe between a first cutting edge of the section of pass-through duct and a second cutting edge arranged on the stopper seat.

2. The valve assembly according to claim 1, wherein the stopper drive further comprises:

an explosion chamber in which an explosive charge is expanded, the explosion chamber arranged to drive a rotation of the rotating stopper so as to shear the production line or the drilling line passing through the rotating stopper, thereby closing the pass-through duct.

3. The valve assembly according to claim 2, wherein the stopper drive expands the explosive charge not more than five times in the explosion chamber.

4. The valve assembly according to claim 3, wherein the stopper drive expands the explosive charge not more than once in the explosion chamber.

5. The valve assembly according to claim 2, wherein an explosive product exploded in the explosion chamber is selected from the group consisting of a solid explosive product and a pyrotechnical charge.

6. The valve assembly according to claim 1, wherein the stopper drive further comprises:

an expansion chamber in which a chemical substance is expanded at a slower expansion rate relative to an explosion or a detonation, the expansion chamber arranged to actuate a rotation of the rotating stopper so as to shear the production line or the drilling line passing through the rotating stopper, thereby closing the pass-through duct.

7. The valve assembly according to claim 1, wherein the rotating stopper is selected from the group consisting of a ball stopper, a disc stopper, and a rotating drum stopper.

8. The valve assembly according to claim 1, wherein the pipe comprises at least one characteristic selected from the group consisting of:

the pipe having an external diameter equal to or greater than 5 inches;

the pipe having an average wall thickness equal to or greater than 0.2 inches; and the pipe having walls comprising a material having a breaking load equal to or higher than 80 Kpsi.

9. The valve assembly according to claim 8, wherein the material is steel.

10. An extraction well, comprising:

a first anchoring pipe fixed to a seabed or other geological formation where an underground reservoir to be exploited lies, the first anchoring pipe situated close to a surface of the seabed or the other geological formation;

a wellhead situated in correspondence with or close to an end of the first anchoring pipe;

the emergency valve assembly according to claim 1 and assembled on the wellhead; and the pipe of the at least one of the production line and the drilling line, wherein the pipe passes through the rotating stopper and is arranged to contain and transport the extraction fluids or other fluids extracted from the reservoir.

11. The extraction well according to claim 10, further comprising:

a safety valve assembled in fluid communication downstream of the emergency valve assembly and arranged to stop a stream of fluid extracted from the reservoir, the stream of fluid to flow along the pipe before being stopped by the emergency valve assembly.

12. The extraction well according to claim 11, wherein the safety valve is a blowout preventer.

13. A process for managing an extraction well under emergency conditions, the process comprising:

providing an extraction well comprising:

a first anchoring pipe fixed to a seabed or other geological formation where an underground reservoir to be exploited lies, the first anchoring pipe arranged close to a surface of the seabed or the other geological formation;

a wellhead arranged in correspondence with or close to an end of the first anchoring pipe;

the emergency valve assembly according to claim 1 and assembled on the wellhead; and the pipe of the production line or the drilling line, which is arranged to contain and transport the extraction fluids from the reservoir and passes through the rotating stopper; and rotating the rotating stopper so as to shear the pipe and close the pass-through duct, stopping or reducing a flow of fluids extracted from the reservoir through the pipe.

14. The process according to claim 13, further comprising:

driving the rotation of the rotating stopper by actuating the stopper drive employing at least one selected from the group of a Remote Operated Vehicle, a remote-controlled vehicle, and an acoustic signal.

15. The process according to claim 13, further comprising:

positioning the emergency valve assembly on a seabed submerged by a water seal at least 1,000 meters deep.

16. The process according to claim 15, wherein the emergency valve assembly is positioned on the seabed submerged by the water seal at least 2,500-4,500 meters deep.

17. The valve assembly according to claim 1, wherein the extraction fluids comprise at least one from the group consisting of petroleum, oil, water, sludge, rock debris, earth, and natural gas.

* * * * *